US005903120A

United States Patent [19]

Shin

[11] Patent Number: 5,903,120

[45] **Date of Patent: *May 11, 1999**

[54] CLOTHES WASHING MACHINE HAVING A TWO-PIECE DOOR PULLED OPEN AND CLOSED BY A MOTOR-DRIVEN WIRE ARRANGEMENT

[75] Inventor: Jeong-Soo Shin, Suwon, Rep. of Korea

[73] Assignee: Samsung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/611,088

[22] Filed: Mar. 5, 1996

[30] Foreign Application Priority Data

| | | | |
|---|---|---|---|
| Apr. 28, 1995 | [KR] | Rep. of Korea | 95-9025 U |
| Apr. 28, 1995 | [KR] | Rep. of Korea | 95-9026 U |
| May 9, 1995 | [KR] | Rep. of Korea | 95-9795 U |
| Jul. 10, 1995 | [KR] | Rep. of Korea | 95-16936 U |

[51] Int. Cl.[6] ..... H02P 1/00

[52] U.S. Cl. ..... 318/283; 220/263

[58] Field of Search ..... 312/16, 480, 220–286; 220/260, 263, 283, 262; 49/25, 31, 32, 138, 41, 340; 160/292

[56] References Cited

U.S. PATENT DOCUMENTS

| | | | |
|---|---|---|---|
| 3,891,115 | 6/1975 | Ono | 49/254 |
| 4,007,409 | 2/1977 | Thibaut | 318/459 |
| 4,026,343 | 5/1977 | James | 160/189 |
| 4,819,459 | 4/1989 | Keith | 68/3 R |
| 4,883,189 | 11/1989 | Lobbert | 220/211 |
| 5,267,344 | 11/1993 | Nelson | 318/439 |
| 5,329,212 | 7/1994 | Feigleson | 318/16 |
| 5,546,773 | 8/1996 | Lee | 68/196 |
| 5,585,704 | 12/1996 | Elzind | 318/446 |
| 5,724,837 | 3/1998 | Shin | 68/196 |

*Primary Examiner*—Jonathan Wysocki

*Attorney, Agent, or Firm*—Burns, Doane,Swecker & Mathis, L.L.P.

[57] ABSTRACT

A clothes washing machine includes a housing in which a wash tub is disposed. The housing includes a top cover in which an opening is disposed to enable clothes to be inserted into, or removed from the wash tub. The opening is closed by an openable door. The door is openable in response to the depressing of a foot pedal by a user. The foot pedal can be operably connected to the door by a wire arrangement such that the force for opening the door is provided by the user's foot. Alternatively, the foot pedal or a button could be connected to a motor which is connected to the door for opening the door when the foot pedal (or button) is depressed.

2 Claims, 15 Drawing Sheets

CLOTHES WASHING MACHINE HAVING A TWO-PIECE DOOR PULLED OPEN AND CLOSED BY A MOTOR-DRIVEN WIRE ARRANGEMENT

BACKGROUND OF THE INVENTION

1. Field of the Invention

The present invention relates to a door opening apparatus of a washing machine, and more particularly to a door opening apparatus for a washing machine.

2. Description of the Prior Art

Referring to FIG. 1, the structure of a washing machine according to an epicyclic gear reduction method disclosed in the prior art will be described.

A body 5 of the washing machine is provided at an upper surface thereof with a top cover 10 hinge-coupled to a folding door 1, and a washing tub 20 is provided therein.

The washing tub 20 is provided at an external bottom surface thereof with driving means 30, which is fastened by fastening means (not shown). The driving means 30 is provided on an axle thereof with a motor pulley 38 and a cooling fan 36, which is connected to a pulley 42 by way of a belt 40.

The pulley 42 is provided at an upper portion thereof with a clutch fastening unit 46 meshed with a clutch boss 44.

At an upper portion of the clutch boss 44, there is axially provided a power transmission means 50 which is driven by power transferred from the driving means 30.

The power transmission means 50 is equipped at a tip thereof with a spin-dry tub 60 disposed in the washing tub 20 so that spin-drying can be performed by the power transferred from the power transmission means 50 while the spin-dry tub 60 is being rotated.

The spin-dry tub 60 is provided at a bottom surface thereof with a pulsator 70 for receiving the power from the power transmission means 50 for rotation in forward and reverse directions to thereby cause turbulent flow of the washing water in the spin-dry tub 60, and at the same time, to give the laundry a physical force for performance of agitation and washing thereof.

Meanwhile, the body 5 of the washing machine is provided at the upper surface thereof with water supply means 80 for supplying the washing water into the spin-dry tub 60 and is provided with drainage means 90 for draining the washing water in the spin-dry tub 60. The water supply means 80 is provided at a lower end thereof with detergent dissolving means 100 for dissolving deposited detergent by way of supplied water to thereby supply the same with the washing water into the washing tub 20 and the spin-dry tub 60.

In the conventional washing machine thus constructed, when the laundry is inserted into the spin-dry tub 60 by opening the folding door 1, a predetermined quantity of detergent is inserted into the detergent dissolving means 100 and an electric power is applied, the washing water passes through the detergent dissolving means 100 by way of the water supply means 80, and, at the same time, is supplied into the washing tub 20 and the spin-dry tub 60 along with the dissolved detergent.

After a few seconds, a washing axle of the power transmission means 50 is driven at a reduced speed through the medium of the belt 40 according to drive of the driving means 30, to thereby cause the pulsator 70 to oscillate in the forward and reverse directions. Then, the flow of water current in the washing tub 20 and the spin-dry tub 60 is made turbulent and the laundry is given a physical force, and then agitated and washed evenly. After the lapse of a predetermined period, when the rotation of the pulsator 70 is stopped according to a stop signal from the driving means 30 and the power transmission means 50, most of the polluted water in the washing tub 20 and the spin-dry tub 60 is drained out through a plurality of drainage holes 61 formed around a floor and a periphery of the spin-dry tub 60, and at the same time, is drained outside through the drainage means 90 connected to the floor of the washing tub 20.

Furthermore, residual polluted water is forced from the laundry by centrifugal force of the spin-dry tub 60 rotating at a high speed for a few seconds according to intermittent spin-drying processes through the drainage holes 61 of the spin-dry tub 60, and, at the same time, is all drained outside of the washing machine through the drainage means 90.

Meanwhile, in case of the rinsing process, when a valve closing operation of the drainage means 90 is realized and new washing water (rinsing water) is supplied into the washing tub 20 and the spin-dry tub 60 according to activation of the water supply means 80, the pulsator 70 starts to oscillate and to perform an up-down operation in the same manner as in the aforesaid washing processes, to thereby cause the flow of the water current in the washing tub 20 and the spin-dry tub 60 to be evenly turbulent.

At this time, because the rinsing water tends to easily dissolve detergent residues remaining in the laundry, rinsing frequency may be shortened, and, at the same time, the required quantity of the washing water (tap water) can be reduced.

When the rinsing is completed, the rinsing water is drained through the drainage holes 61 in the spin-dry tub 60 to the drainage means 90, and, at the same time, is discharged outside of the washing machine.

Furthermore, the residual rinsing water absorbed by the laundry by way of the centrifugal force created by the spin-dry tub 60 rotating at a high speed for a few seconds according to the intermittent spin-dry processes is forced through the drainage holes 61 of the spin-dry tub 60, and, at the same time, is completely discharged outside of the washing machine through the drainage means 90 of the washing tub 20.

In the spin-dry process, the spin-dry tub 60 serves to receive the power from a spin-dry axle of the power transmission means 50 to continuously rotate at a high speed for a few seconds, so that the rinsing water remaining in the laundry can be spin-dried.

According to the conventional washing machine thus constructed, when a user lifts up and pushes backward a handle (not shown) of the folding door in order to open the door, the door is in turn folded inwardly to thereby be stood up by way of a hinged portion centrally provided at the door.

Thus, the opening in the top cover is opened to thereby allow the laundry to be inserted thereinto or taken therefrom.

However, there are lots of problems and inconveniences in that the door cannot be handled properly when the user is in a state where hands are full with laundry or with detergent or the like.

SUMMARY OF THE INVENTION

Accordingly, the present invention is disclosed to solve the aforesaid problems, and inconveniences, and it is an object of the present invention to provide a door opening apparatus of a washing machine by which a door can be automatically opened or closed by way of a pressing operation of a button to thereby provide a convenience in insertion of the laundry into or taking same out of the spin-dry tub.

It is another object of the present invention to provide a door opening apparatus of a washing machine by which the door can be automatically opened or closed by way of a simple foot-stepping operation to thereby allow the laundry to be easily inserted into or taken out of the spin-dry tub.

The door opening apparatus of a washing machine according to the present invention comprises:

folding door means for being hinge-jointed to a top cover;

guide means for being rolled along an edge surface of the top cover when the door means is being folded to thereby guide the door means;

a bobbin for receiving a driving force of a motor to thereby be rotated in forward or reverse movement;

first and second steel wires for being wound or unwound simultaneously in mutually reverse directions according to forward or reverse rotation of the bobbin to thereby move the guide means in forward or reverse directions and to fold or unfold the door means; and first and second fixing rollers for smoothening operations of the steel wires and guiding to give tension thereto.

The door opening apparatus of a washing machine according to the present invention serves to enable automatic opening and closing of a door according to one-touch manipulation of a button, so that there is an advantage of use in that the laundry can be easily inserted into or taken out of the spin-dry tub.

The door opening apparatus of a washing machine according to the present invention comprises:

folding door means for being hinge-jointed to a rear end of a top cover;

a foot pedal rotatable when stepped on by a user;

traction means for being so hinge-jointed as to be uplifted by the stepping force of the pedal;

a steel wire for being connected between the door means and the traction means so as to raise the door means by way of a force resulting from when the traction force is lifted;

guide means for being hinge-jointed at several places so as to guide operation and movement of the steel wire; and tension means to apply tension to the steel wire.

The door opening apparatus of a washing machine according to the present invention comprises:

folding door means for opening and closing an opening of a top cover;

a pedal rotatable when stepped on;

traction means for being rotated at a predetermined angle by the force of the pedal;

a steel wire for being moved by a force resulting from when the traction means is rotated;

guide means for guiding the operation and movement of the steel wire; and tension means for applying tension to the pedal loosened in tension when released therefrom.

The door opening apparatus of a washing machine according to the present invention comprises:

control means;

power supply means for supplying direct current DC voltage to the control means;

door detecting means for detecting whether a door is opened;

pedal press detecting means for detecting whether a pedal is pressed; and a motor driving circuit for receiving a control signal from the control means according to a detected signal output from the pedal press detecting means and the door detecting means to thereby drive a motor for opening the door.

BRIEF DESCRIPTION OF THE DRAWINGS

For a more complete understanding of the nature and objects of the invention, reference should be made to the following detailed description taken in conjunction with the accompanying drawing in which.

Figure 6:
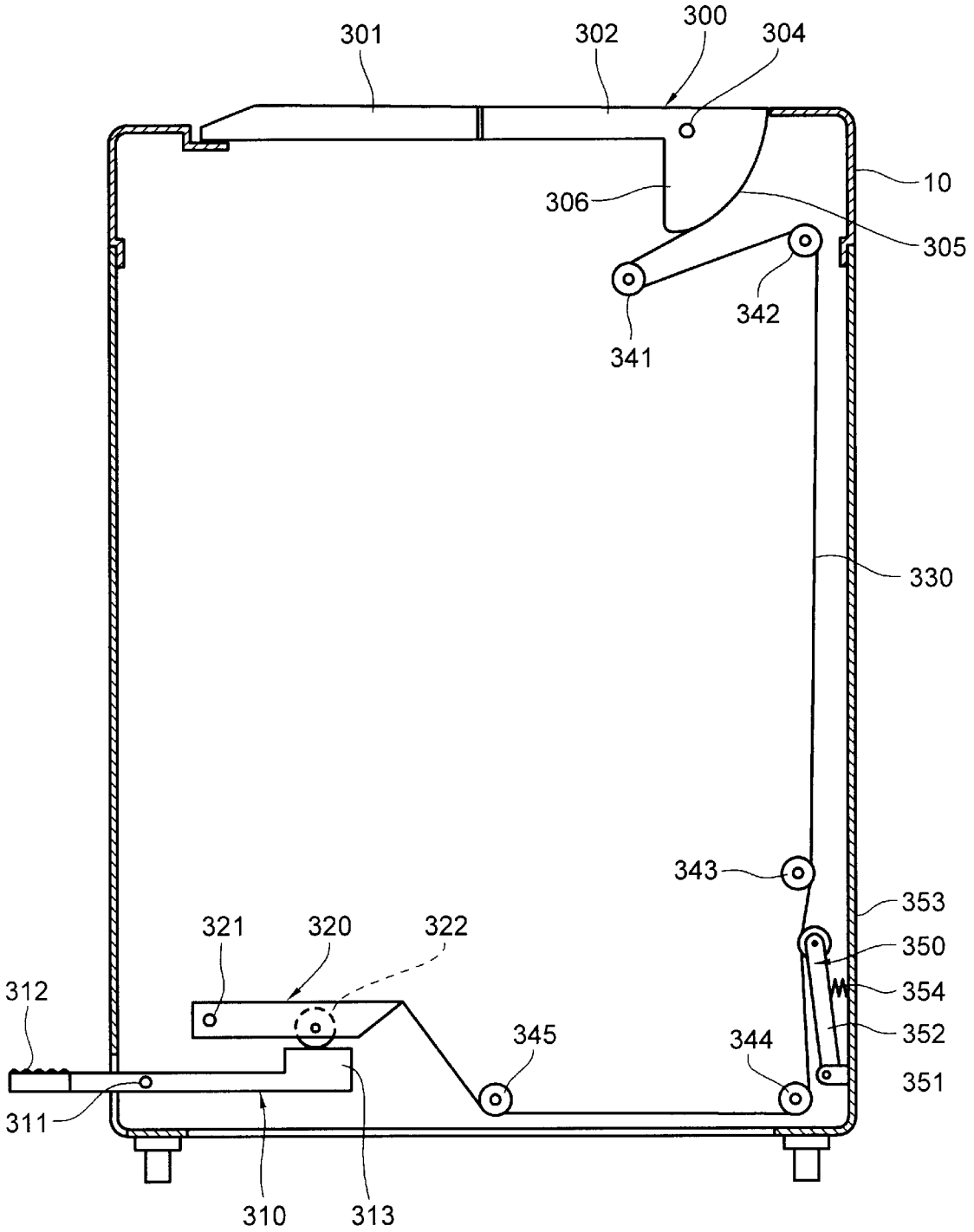
Figure 7:
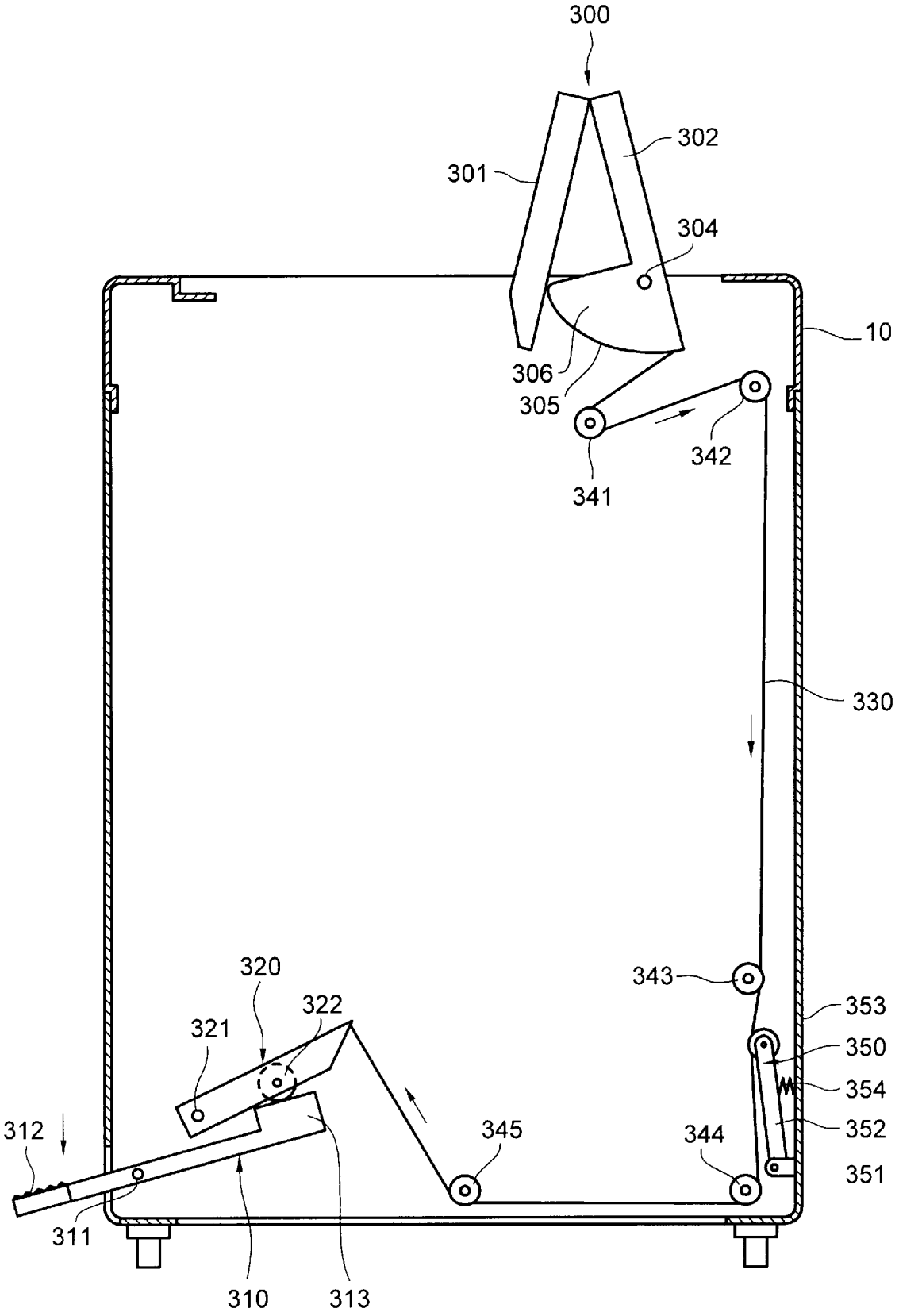
Figure 8:
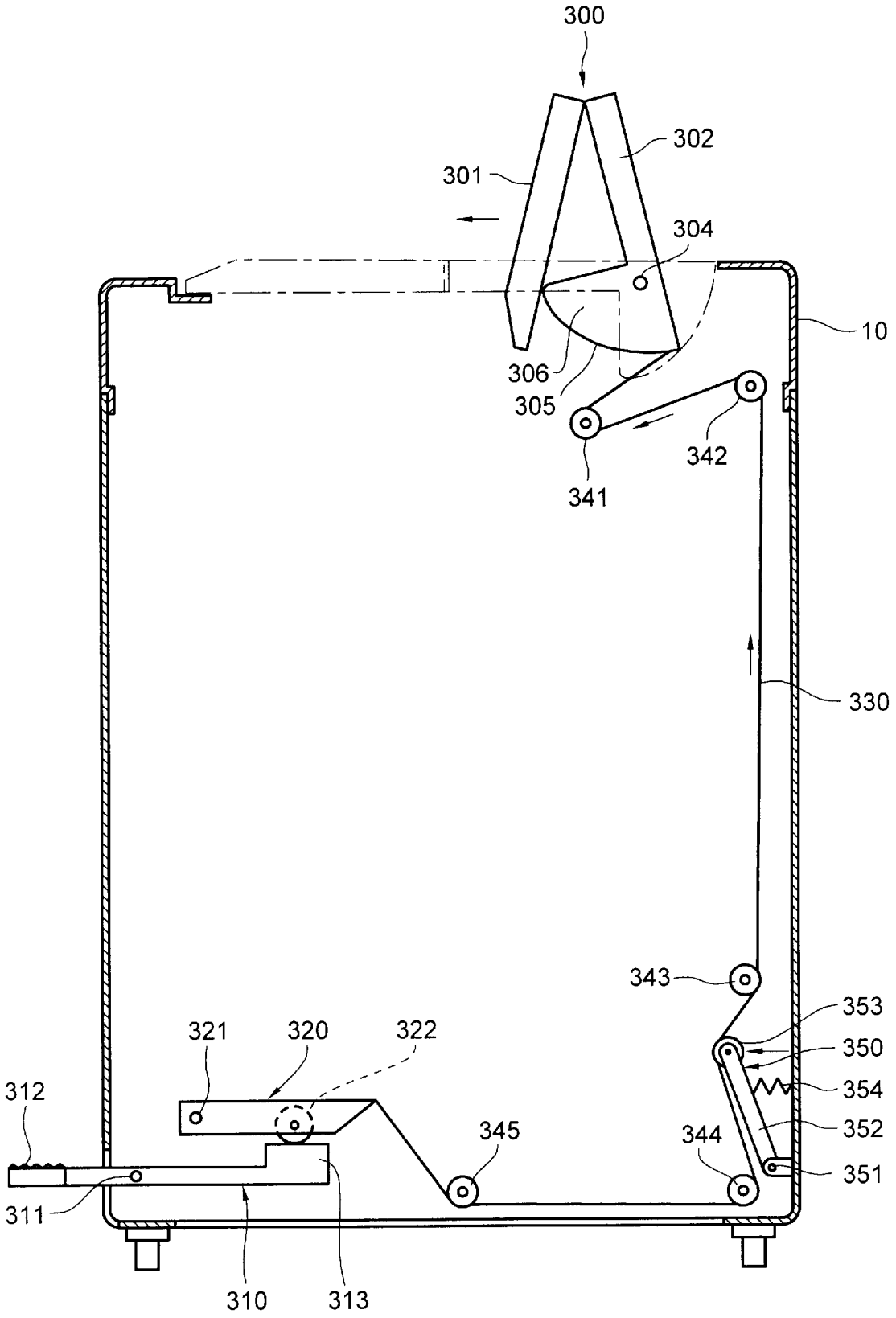
Figure 9:
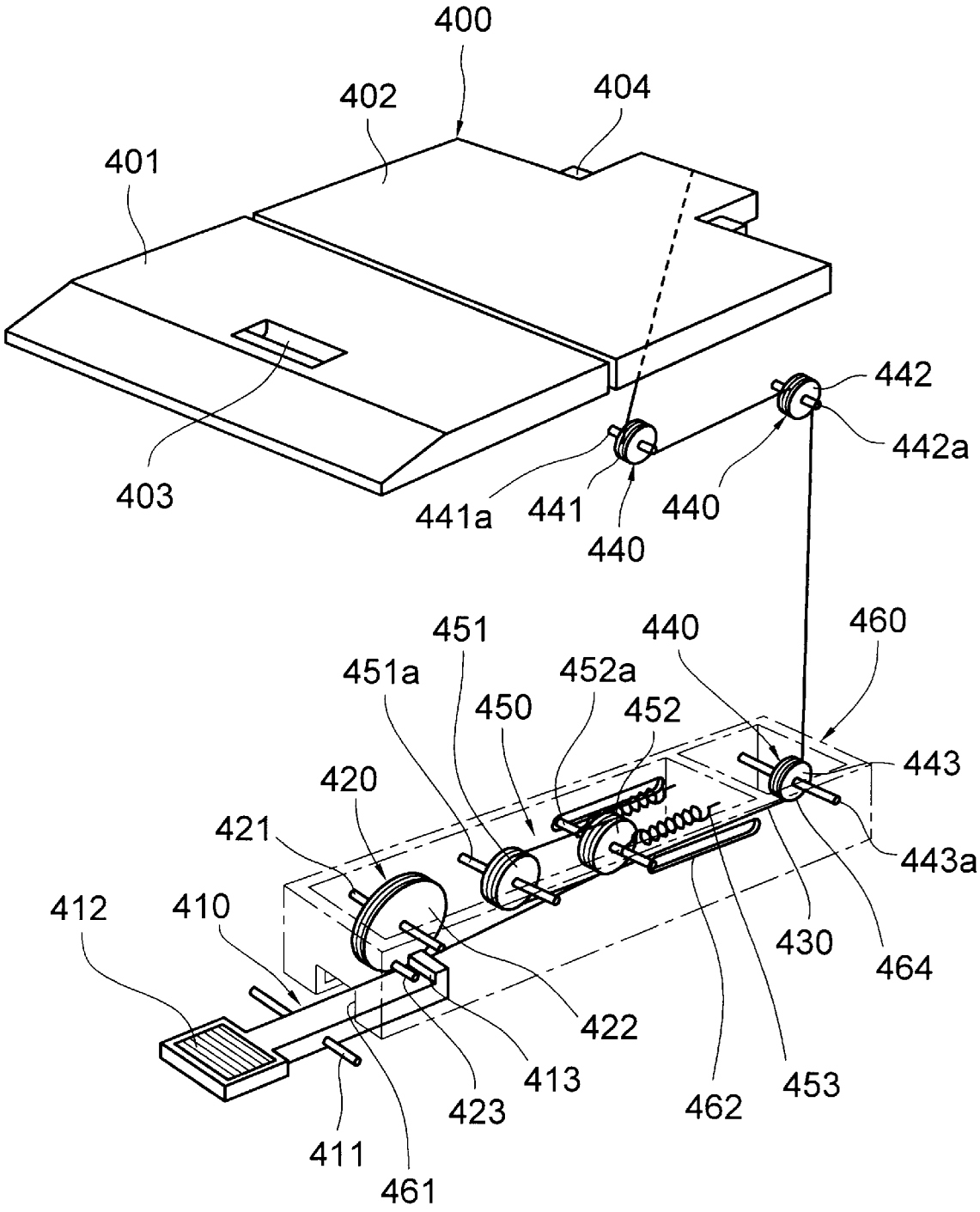
Figure 10:
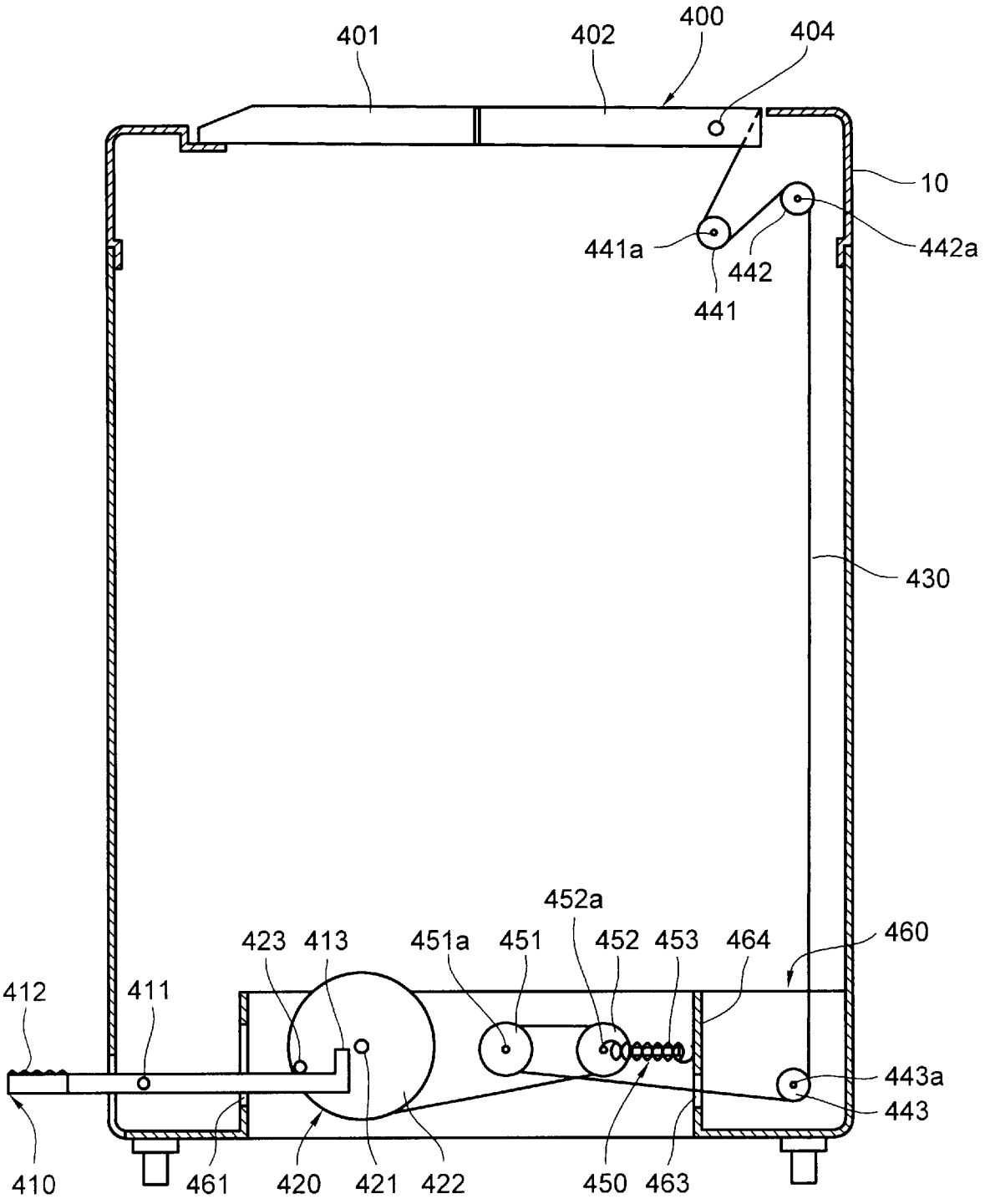
Figure 11:
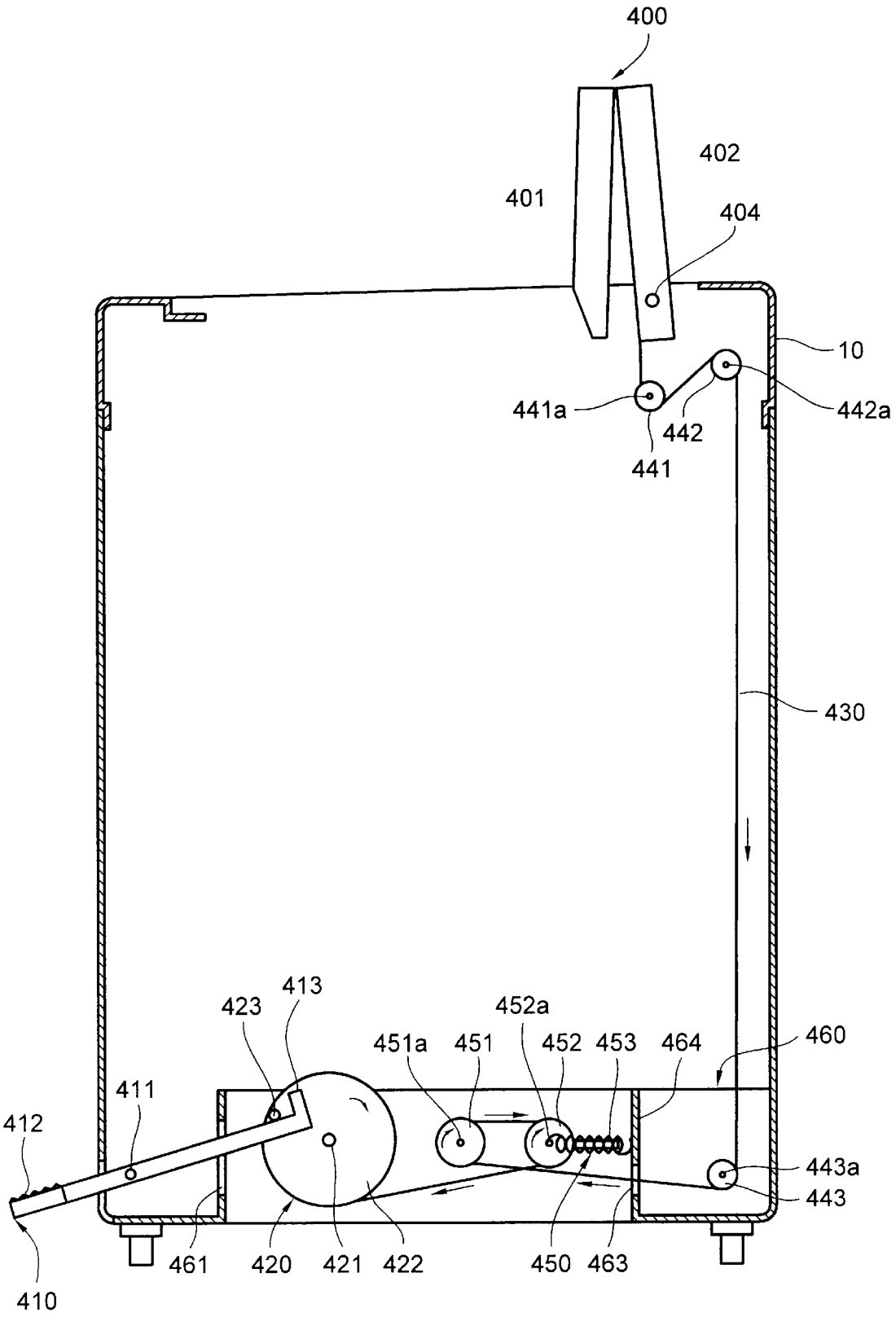
Figure 12:
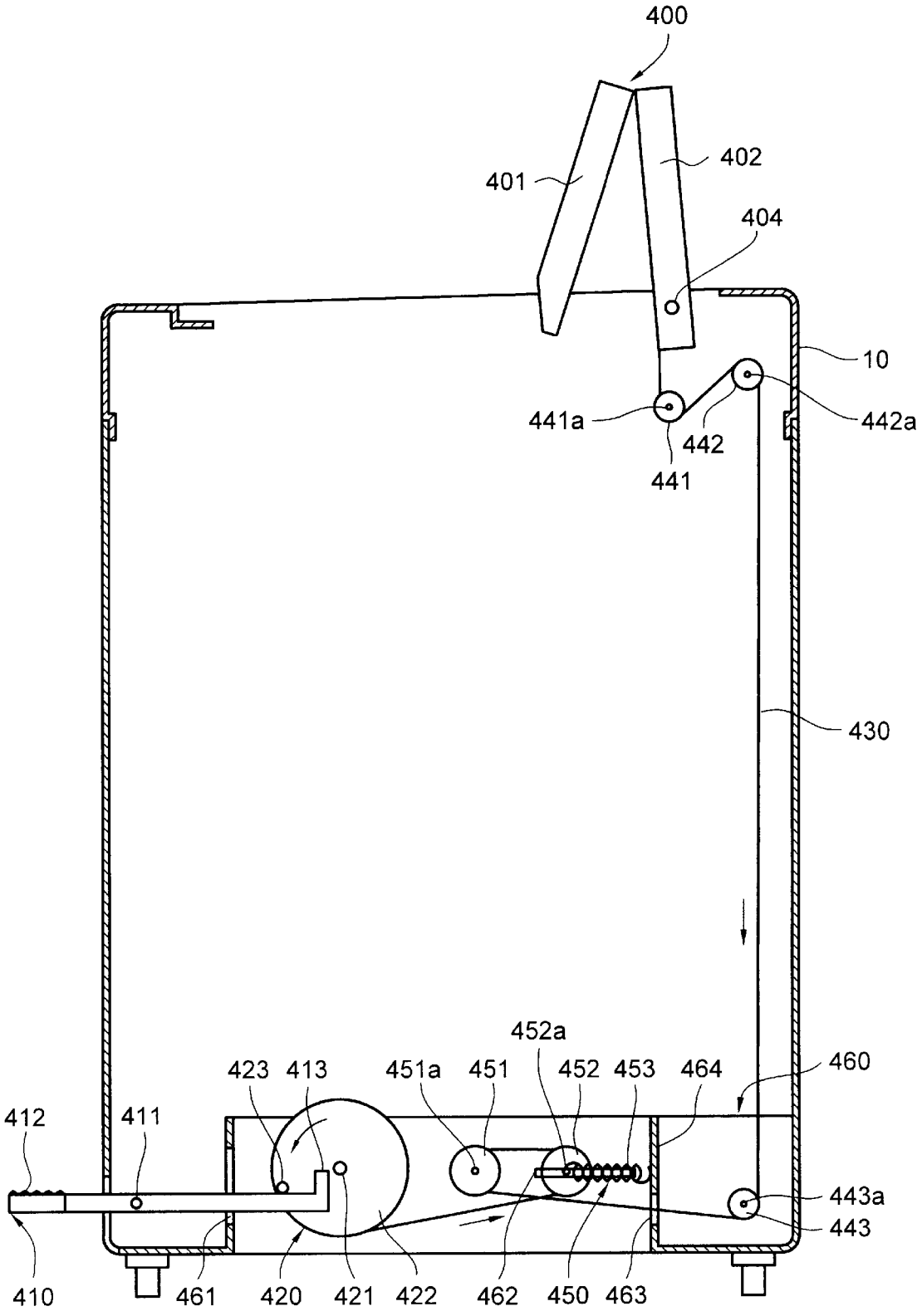
Figure 13:
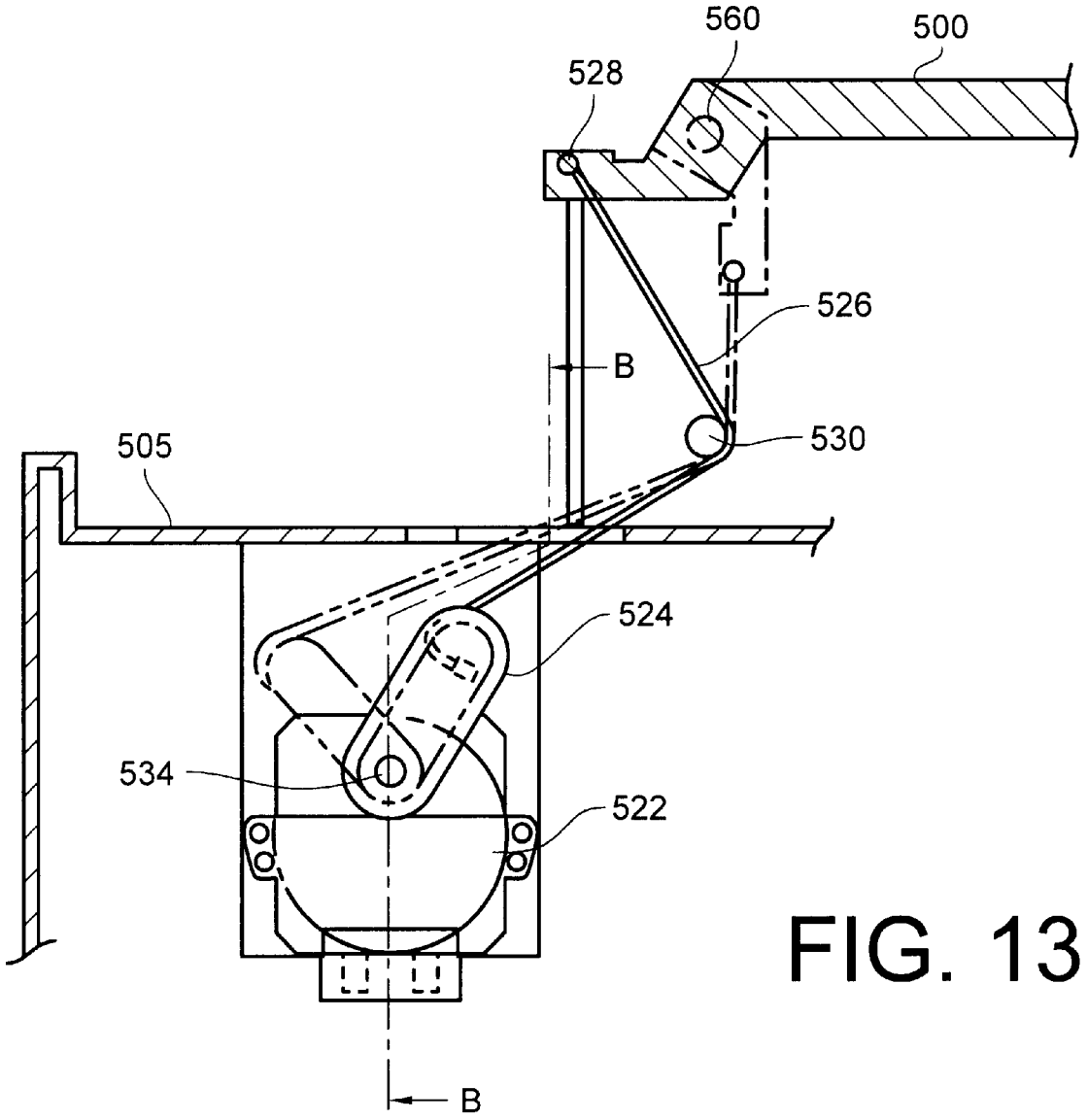
Figure 14:
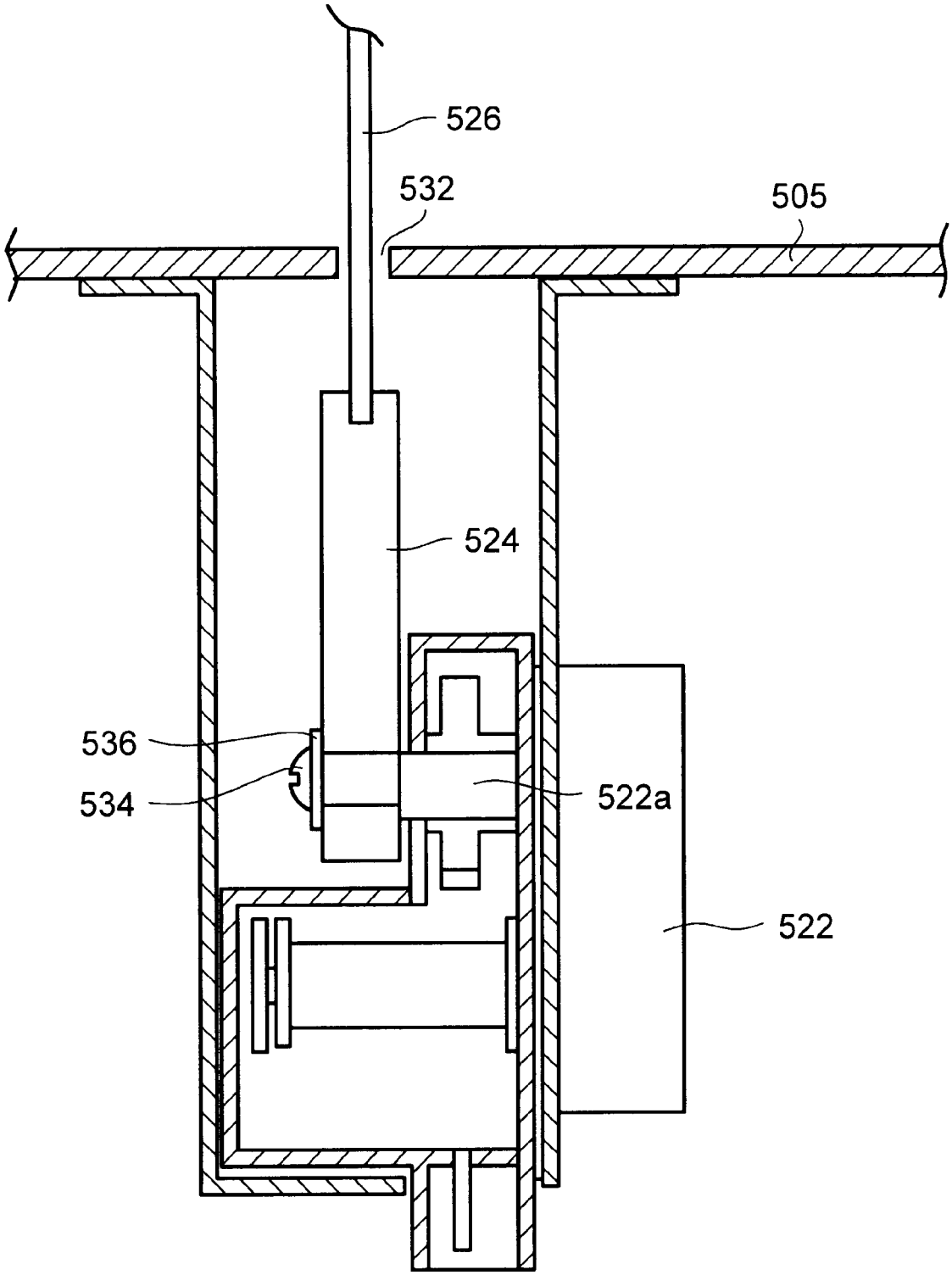
Figure 15:
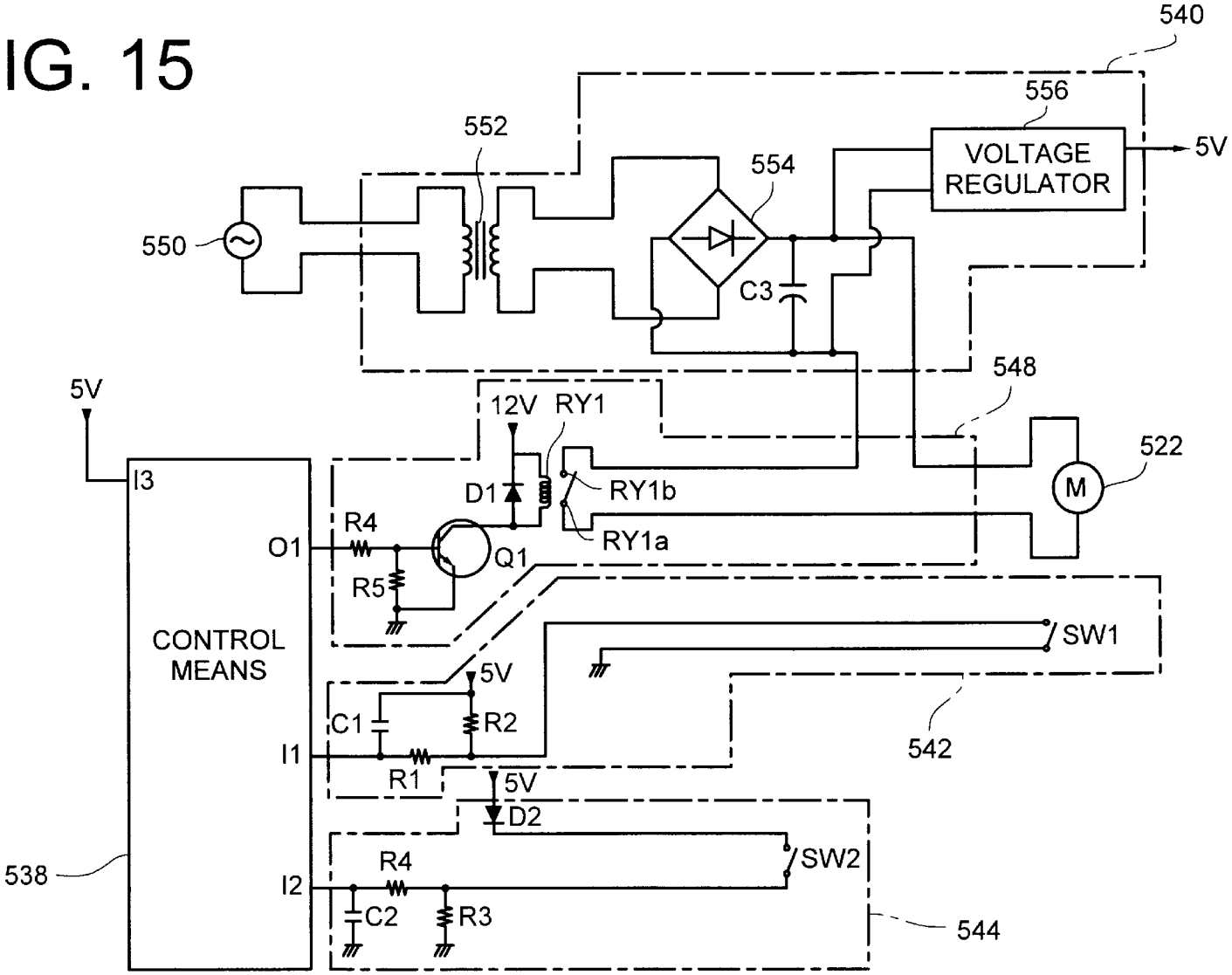
Figure 16:
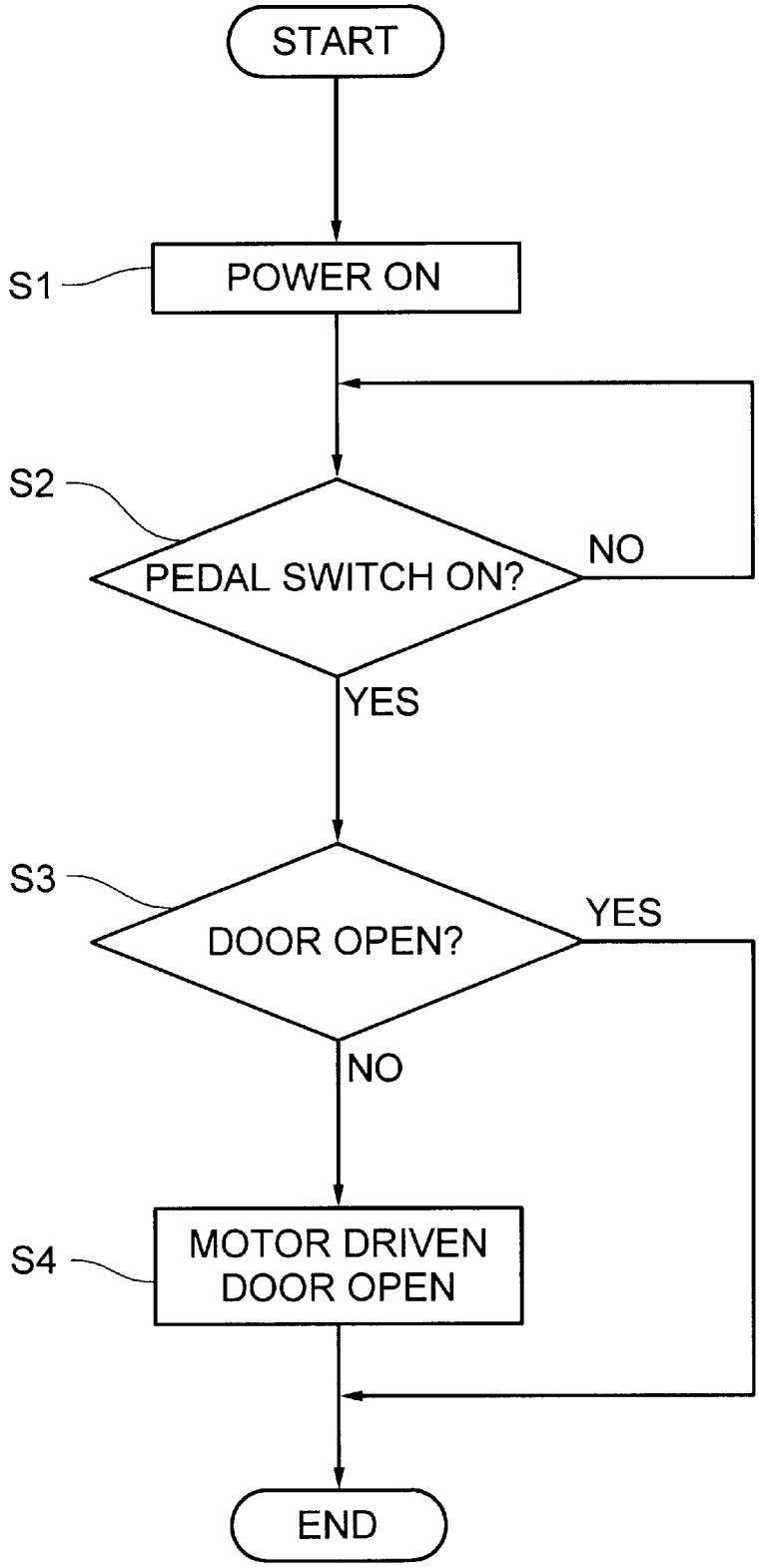

FIG. **5*a*** is a fragmentary sectional view of a pulley formed integrally on a rear door of the second embodiment;

FIG. 6 is a sectional view for illustrating a state where the door opening apparatus is closed according to the second embodiment of the present invention;

FIG. 7 is a sectional view for illustrating a state where the door opening apparatus is opened according to the second embodiment of the present invention;

FIG. 8 is a sectional view for illustrating a state where a door of the door opening apparatus can be closed according to the second embodiment of the present invention;

FIG. 9 is an exploded perspective view for illustrating a door opening apparatus according to third embodiment of the present invention;

FIG. 10 is a sectional view for illustrating a state where the door opening apparatus is closed according to the third embodiment of the present invention;

FIG. 11 is a sectional view for illustrating a state where the door opening apparatus is opened according to the third embodiment of the present invention;

FIG. 12 is a sectional view for illustrating a state where a door of the door opening apparatus can be closed according to the third embodiment of the present invention;

FIG. 13 is a fragmentary sectional view of a door opening apparatus according to a fourth embodiment of the present invention;

FIG. 14 is a sectional view taken along line 14—14 in FIG. 13;

FIG. 15 is a circuit diagram of a door opening apparatus of a washing machine according to the fourth embodiment of the present invention; and FIG. 16 is a flow chart of the door opening apparatus of a washing machine according to the fourth embodiment of the present invention.

DETAILED DESCRIPTION OF PREFERRED EMBODIMENTS OF THE INVENTION

The present invention will now be described in detail with reference to the accompanying drawings according to the respective embodiments.

Figure 1:
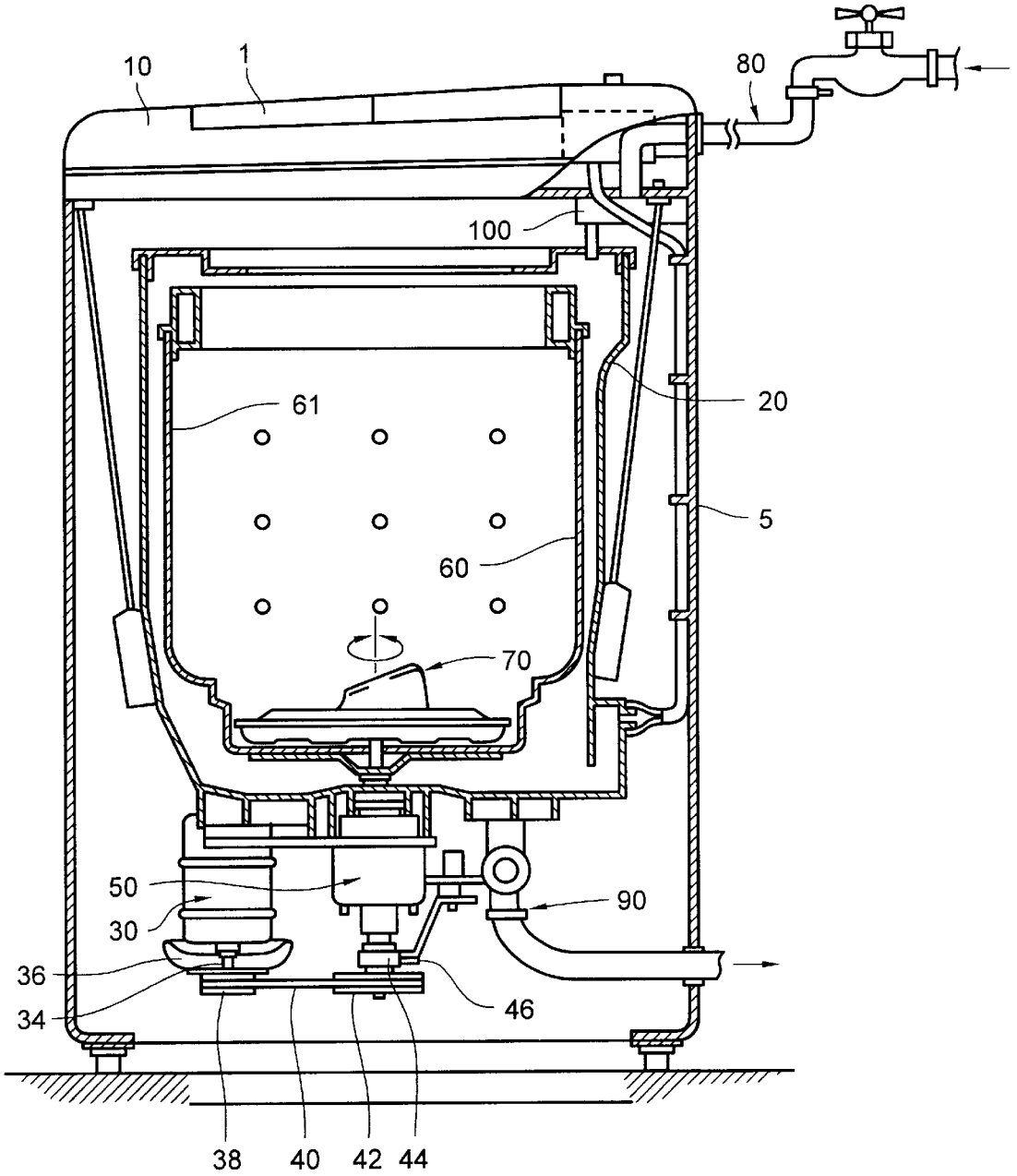
FIG. 1 (PRIOR ART)
FIG. 1 is an overall sectional view of a washing machine according to the prior art.

Throughout the drawings, like reference numerals as in FIG. 1 are used for designation of like or equivalent parts or portions for simplicity of illustration and explanation. Redundancy is also omitted.

Figure 2:
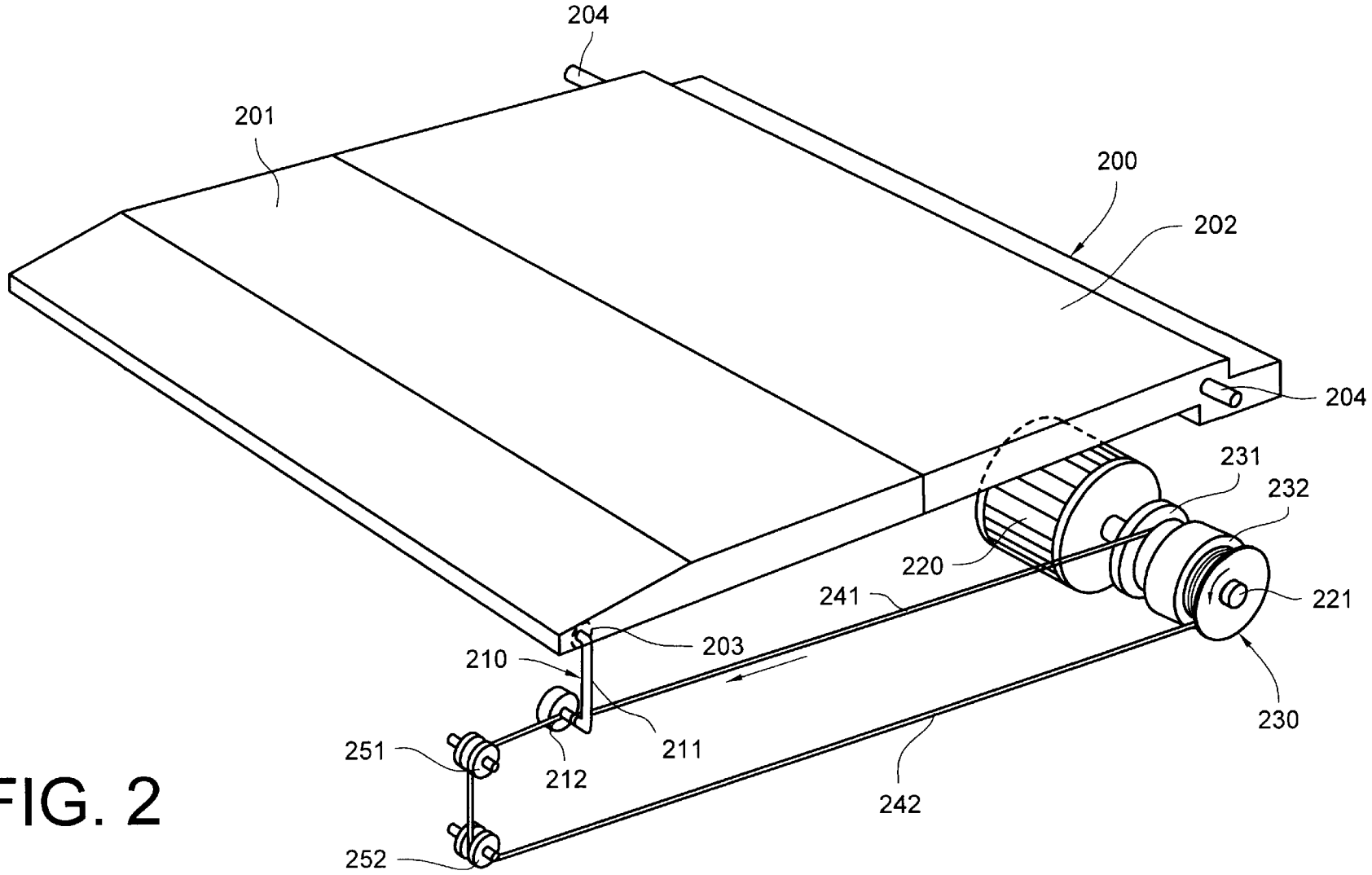
FIG. 2 is a perspective view for illustrating a door opening apparatus according to a first embodiment of the present invention.

FIG. 2 is a perspective view of a door opening apparatus of a washing machine according to a first embodiment of the present invention.

As illustrated in FIG. 2, the door opening apparatus of a washing machine includes:

(a) folding door means 200 hinged to a top cover 10 so as to open and close an opening, (b) guide means 210 carried by the door means for rolling along an edge surface of the top cover 10 when the door means 200 is folded or unfolded to thereby guide smooth folding operation of the door means 200, (c) a motor 220 for being disposed at a predetermined portion in the top cover 10 to thereby be driven by an electric power source (not shown), (d) a bobbin 230 for receiving a driving force of the motor 220 to thereby be rotated in forward or reverse movement, (e) first and second steel wires 241 and 242 for being wound or unwound simultaneously in mutually reverse directions according to forward or reverse rotation of the bobbin 230 to thereby move the guide means 210 in a forward or reverse direction and to fold or unfold the door means 210, and (f) first and second fixing rollers 251 and 252 for smoothening operations of the steel wires and guiding means to give tension thereto.

The door means 200, as shown in FIG. 2, has a front door 201 and a rear door 202 hinged together. The front door 201 is formed at a front side thereof with a fixed protruder 203 so as to fix the guide means 210, and the rear door 202 is respectively formed at rear side walls thereof with a pair of hinge pins 204 for being hinge-coupled to the top cover 10. The guide means 210 faces the fixed protruder 203.

The guide means 210 includes a fixed lever 211 having one end thereof bent inwardly and a roller 212 rotatively mounted to a lower end of the fixed lever 211 so as to roll in forward and backward directions while being in touch with a bordering edge surface of the opening of the top cover 10.

The bobbin 230 is respectively formed at left and right sides of a periphery thereof with "V"-shaped first and second guiding grooves 231 and 232 at a predetermined interval so that the first and second steel wires 241 and 242 can respectively be wound and unwound therein.

The first steel wire 241 is fixedly connected at one end thereof to the fixed lever 211 of the guide means 210, and at the other end thereof to the first guiding groove 231 of the bobbin 230.

Furthermore, the second steel wire 242 is fixedly connected at one end thereof to the fixed lever 211 of the guide means 210 and passes over vertically spaced rollers 251 and 252.

The second steel wire 242 is fixedly connected at the other end thereof to the second guiding groove 232 of the bobbin 230.

The first and second fixing rollers 251 and 252 are mounted for rotation at a front side wall (not shown) of the top cover 10.

Now, the operation of the door opening apparatus of a washing machine thus constructed according to the first embodiment of the present invention will be described.

Figure 3:
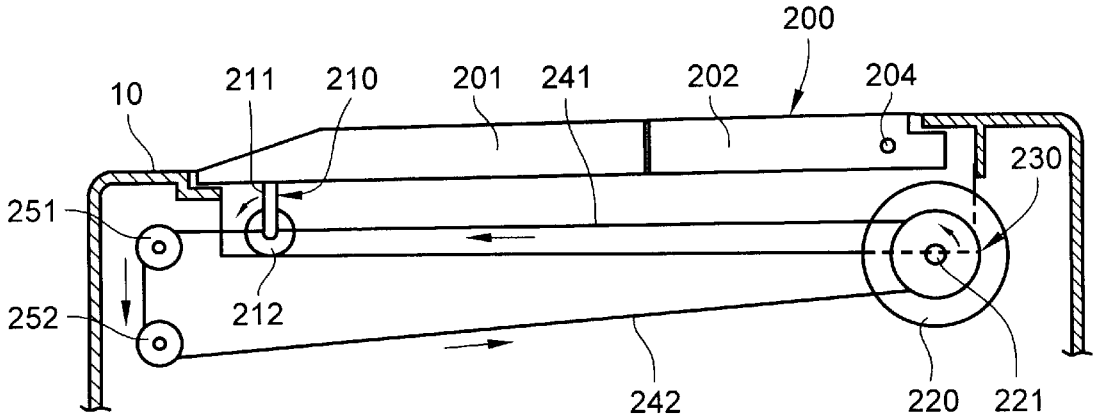
FIG. 3 is a sectional view for illustrating a state where a door is closed according to the first embodiment of the present invention.

FIG. 3 is a sectional view for illustrating a state where the door means is closed.

As illustrated in FIG. 3, when a user presses a button at a control box (not shown) at the top cover 10 in order to open the opening by lifting the door means 200, an electric source is applied to thereby drive the motor 220. The bobbin 230 is then rotated in one direction through the medium of a motor axis 221, thereby winding up the first steel wire 241 and unwinding the second steel wire 242.

The fixed lever 211 of the guide means 210 fixedly coupled to the front door 201 is fixedly connected to respective ends of the first and second steel wires 241 and 242 to thereby be moved backward simultaneously when the first steel wire 241 is wound on the bobbin 230.

The fixed lever 211 then serves to cause the roller 212 to roll along the top cover 10 and move the front door 201 backward.

Figure 4:
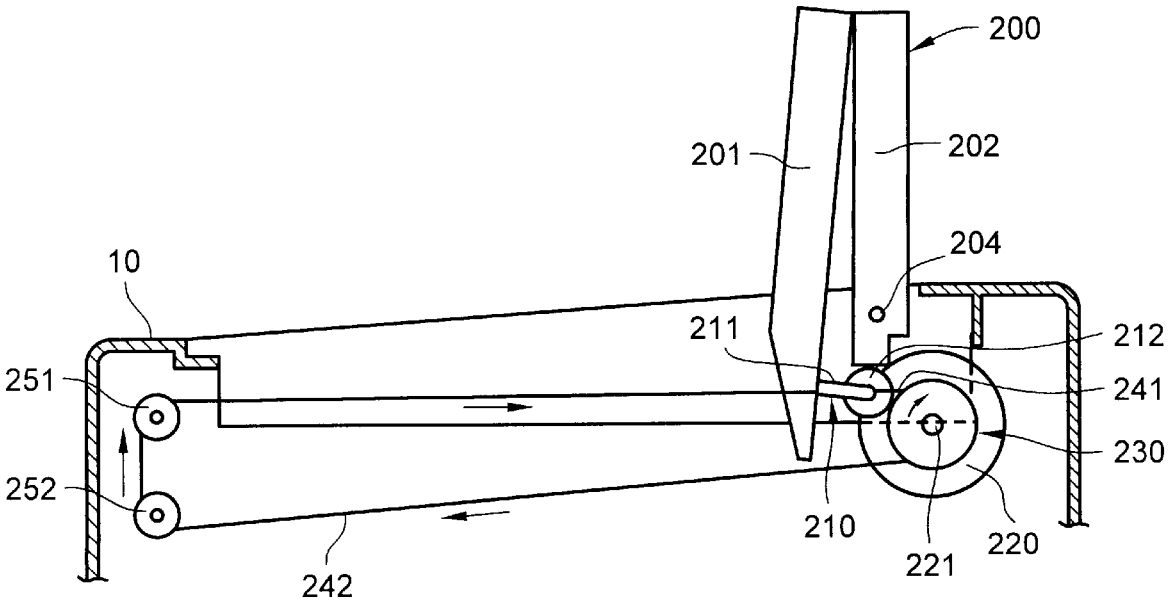
FIG. 4 is a sectional view for illustrating a state where a door is opened according to the first embodiment of the present invention.

The front side of the front door 201, as illustrated in FIG. 4, is caused to face downward,and, at the same time, the rear side of the front door faces upward.

The front side of the rear door 202 is caused to face upward by the force generated when the front door 201 is folded in an upright position while a rear side of the rear door faces downward, so that the door means is folded.

As shown in FIG. 4, the opening of the top cover 10 is now open to allow the same to accept or discharge the laundry in the spin-dry tub 60.

Meanwhile, when the user presses the button (not shown) again to close the opening at the top cover 10 after the laundry is inserted into or taken out of the spin-dry tub 60, the electric power source is applied according to a signal caused by the pressing of the button to thereby drive the motor 220. The bobbin 230 is rotated in the reverse direction through the medium of the motor axis 221 so that the first steel wire 241 is unwound while the second steel wire 242 is wound up.

The fixed lever 211 is simultaneously moved forward to thereby cause the roller 212 to roll along the upper surface of the opening of the top cover 10 and pull the front door 201 forwardly.

The front door 201 and the rear door 202 are simultaneously unfolded or flattened to thereby close the opening of the top cover 10 as seen in FIG. 3.

As is apparent from the foregoing, there is an advantage in the door opening apparatus of a washing machine according to the first embodiment of the present invention, compared with the prior art, in that a steel wire is pulled backward by forward rotation of a bobbin, to thereby pull open the door means, or the steel wire is pulled forward by reverse rotation of the bobbin, to thereby push the door means, and, at the same time, to cause the same to be folded and lie flattened.

The second embodiment of the present invention will now be described in detail with reference to FIGS. 5–8.

The door opening apparatus of a washing machine according to the second embodiment of present invention comprises:

(a) folding door means 300 for being hinged to a rear end of the top cover 10 in order to open and close an opening of the top cover 10;

(b) a pedal 310 for being pivoted by a stepping force thereon;

(c) traction means 320 for being rotated by a predetermined angle by the stepping force of the pedal 310;

(d) a steel wire 330 for transmitting a force when the traction means 320 is lifted;

(e) guide means 340 for guiding movement of the steel wire 330; and (f) tension means 350 for applying tension to the wire 330 and pedal 310.

Figure 5:
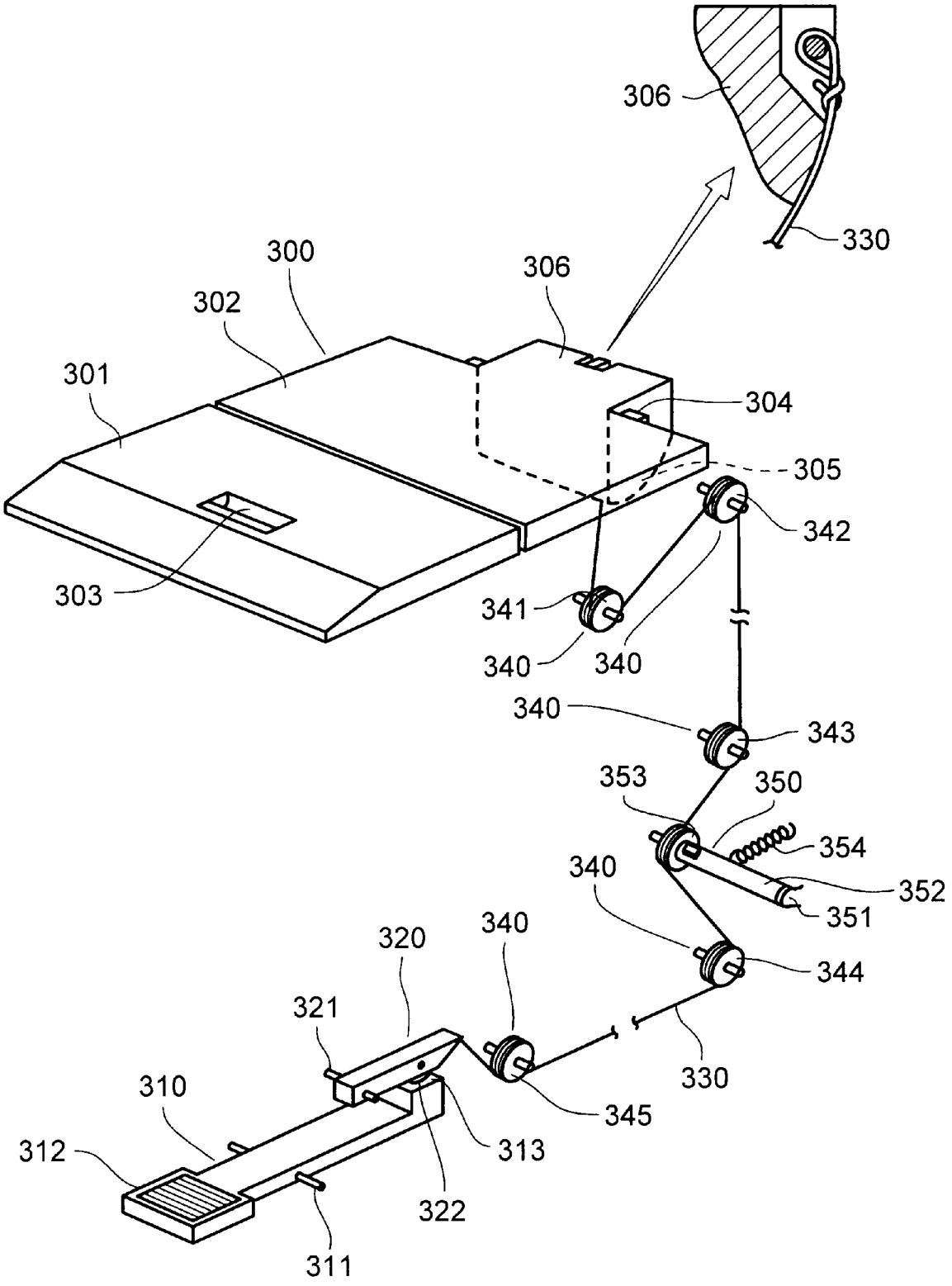
FIG. 5 is a perspective exploded view for illustrating a door opening apparatus according to a second embodiment of the present invention.

The door means 300, unlike the description in the first embodiment and as illustrated in FIG. 5, has a front door 301 and a rear door 302 hinge-coupled for folding and unfolding performances, where, the front door 301 is disposed at an upper central portion thereof with a handle 303, and the rear door 302 is formed at a rear end thereof with a hinge axis 304 so as to be fixedly hinged to the top cover 10.

The rear door 302 is fixedly connected at a rear bottom surface thereof to the steel wire 330, and, at the same time, is integrally formed with a pulley 306 (see FIG. 5*a*) having a curvature surface 305 thereon, so that the same can be rotated by a downward movement of the steel wire 330 to thereby lift the front and rear doors 301 and 302.

The pedal 310 has a pair of hinge axles 311 so as to be hinge-coupled to a floor within the washing machine.

The pedal 310 is also formed at a front side thereof with a foot-actuable tread 312 exposed through a lower front end of the washing machine.

The pedal 310 is integrally formed at a rear end thereof with a protruded contact unit 313 so as to touch a rear bottom surface of the traction means 320.

Meanwhile, the traction means is formed at a front end thereof with a pair of hinge axles 321 so as to be hinge-coupled to the floor within the washing machine, and at a rear bottom surface thereof. The traction means has a roller 322 contacted by the contact unit 313 to thereby guide a smooth upward movement thereof.

The guide means 340 includes, as illustrated in FIGS. 5 and 6, a first roller 341 for being rotatively hinge-coupled to a front upper part of a rear wall in the washing machine so that the steel wire 330 can roll along in touch with a lower periphery thereof, a second roller 342 for being rotatively hinge-coupled to an upper rear part of the rear wall in the washing machine so that the steel wire 330 can roll along in touch with an upper periphery thereof, a third roller 343 for being rotatively hinge-coupled to a middle part of the rear wall in the washing machine so that the steel wire 330 can roll along in touch with a rear periphery thereof, a fourth roller 344 for being rotatively hinge-coupled to a rear floor part in the washing machine so that the steel wire 330 can roll along in touch with the upper periphery thereof, and a fifth roller 345 for being rotatively hinge-coupled to a middle floor part in the washing machine so that the steel wire 330 can roll along in touch with the upper periphery thereof.

The first roller 341 is disposed a little lower in position than the second roller 342.

The tension means 350 includes a lever 352 for being hinge-coupled at a lower end thereof with a hinge axle 351 inserted into the rear wall in the washing machine in between the third roller 343 and the fourth roller 344 of the guide means 340, a roller 353 for being rotatively hinge-coupled to an upper end of the lever 352 so that the steel wire 330 can move therealong, and a compression spring 354 for being disposed between the lever 352 and the rear wall in the washing machine so that the roller 353 can press against the steel wire 330 and tension the same.

Now, the operation of the door opening apparatus of a washing machine according to the second embodiment of the present invention thus constructed will be described.

As illustrated in FIG. 6, when the user steps on the tread 312 of the pedal 310 in order to open the opening of the top cover 10, the pedal 310 is pivoted around a mid-section of the pedal 310, whereupon the rear side thereof is lifted to thereby activate the traction means 320.

The traction means 320 is pivoted around the hinge axis 321 and is lifted at a rear end thereof to thereby attract the steel wire 330.

Meanwhile, the steel wire 330 comes to touch the first, second, third, fourth and fifth rollers 341, 342, 343, 344 and 345 at the guide means 340 to move in a direction as illustrated by an arrow in FIG. 7. The steel wire 330, at the same time, attracts the pulley 306 formed at a rear end of the rear door 302 to rotate the same, so that the contact between the curvature surface 305 and the steel wire 330 can be released.

The rear door 302 is lifted around the hinge axis 304 by the pulley 306, to thereby be erected vertically and at the same time, pulls a rear side end of the front side door 301 so that the front side door 301 can be vertically raised, and, at the same time, folded in parallel with the rear side door 302 to thereby open the opening of the top cover 10.

Meanwhile, when the user releases the pedal 310, the pedal 310 and the traction means 320 are reinstated in their former positions, as illustrated in FIG. 8, by its own weight applied to the rear side end of the pedal 310 and its own weight applied to the rear side end of the traction means 320.

The steel wire 330 remains tensioned by a force applied from the roller 353 disposed at an upper end of the lever 352 which always tends to advance forward by the resilient force of the compression spring 354.

Meanwhile, as illustrated in FIG. 8, when the front door 301 is manually pulled forward by way of the handle 303 (see FIG. 5) formed in the door means 300, the front door 301 and the rear door 302 are unfolded at the same time, and are placed over the opening of the top cover 10, to thereby close the opening.

At the same time, the curvature surface 305 formed at the rear side surface of the pulley 306 is caused to re-contact the steel wire 330.

At this time, the steel wire 330, when the pulley 306 is pulled upward by the reinstating force, remains tensioned by the tension means 350, to thereby close the door means 300 completely, as illustrated in FIG. 6.

As mentioned in the above, according to the door opening apparatus of a washing machine with reference to the second embodiment of the present invention, there is an advantage in that the steel wire is pulled when the pedal is stepped on, to lift the door means and to thereby open the opening of the top cover, so that the laundry can be easily tossed in and out of the spin-dry tub although the hands of the user are full with the laundry or detergent.

Now, a door opening apparatus of a washing machine according to the third embodiment of the present invention will be described with reference FIGS. 9–12.

The door opening apparatus of a washing machine according to the third embodiment of the present invention includes, as illustrated in FIG. 9:

(a) folding door means 400 for opening and closing an opening of a top cover 10;

(b) a pedal 410 for being pivoted by a stepping force thereon;

(c) traction means 400 for being rotated at a predetermined angle by the pedal 410;

(d) a steel wire 430 for transmitting a force when the traction means 420 is rotated;

(e) guide means 440 for guiding the steel wire 430; and (f) tension means 450 for applying tension to the pedal 410.

In other words, a front door 401 and a rear door 402 are hinge-coupled together. The front door 401 is provided at an upper surface thereof with a handle 403 and the rear door 402 is formed at a rear end thereof with a hinge axle 404 so as to be hinged to the top cover 10.

The rear door 402 is fixedly connected at a rear bottom surface thereof to the steel wire 430.

The pedal 410 is formed with a hinge axle 411 so as to be hinge-coupled to a floor in the washing machine.

The pedal 410 is formed at a front side thereof with a tread 412 and at a rear side thereof with a tripping jaw 413 to prevent the same from being dislodged from the traction means 420.

The traction means 420 includes a roller 422 coupled for free rotation to a hinge axle 421 and is fixedly connected to one end of the steel wire 430 and to cause the steel wire 430 to be wound around a periphery thereof during rotation. A tripping pin 423 is fixed to one side of the roller 422 in order to transfer the force of the pedal 410 to thereby rotate the roller 422.

The guide means 440 includes a first roller 441 hinge-coupled for rotation with a first axle 441*a* disposed at an upper front side of a rear wall in the washing machine so as to cause the steel wire 430 to contact a lower periphery thereof, a second roller 442 hinge-coupled for rotation with a second axle 442*a* disposed at an upper rear side of the rear wall in the washing machine so as to cause the steel wire 430 to contact an upper periphery thereof, and a third roller 443 hinge-coupled for rotation with a third axle 443*a* disposed between the floor and the rear wall of the washing machine so as to cause the steel wire 430 to contact a rear periphery thereof.

The tension means includes a fixed roller 451 hinge-coupled for rotation with a fixed axle 451*a* disposed at a mid-section of a supporting member 460 provided on the floor of the washing machine so as to guide the steel wire 430 having passed the third roller 443 at the guide means 450 to make a U-turn, a moving roller 452 mounted for forward and backward movements and rotation through the medium of a moving axle 452*a* at a rear end of the supporting member 460 so as to receive the steel wire 430 having passed the fixed roller 451 and to cause the same to make a U-turn again, and a tension spring 453 fixedly connected between the moving axle 452*a* and the rear wall of the supporting wall 460 so as to give tension to the steel wire 430 by pulling the moving roller 452 backward.

At this location, the supporting member 460 is disposed at an inner front side thereof with the tension means 420, and at an inner rear side thereof with the third roller of the guide means 440, and at an inner middle side thereof with the tension means 450 at one side of the floor in the washing machine.

In other words, the supporting member 460, as illustrated in FIGS. 9 and 10, is formed at a front lower end surface thereof with an opening 461 of a predetermined width so as to receive a rear end of the pedal 410.

The supporting member 460 is provided with oval holes 462, so that both ends of the moving axle 452*a* can be inserted therethrough to thereby move back and forth. The supporting member 460 is formed between a midsection side thereof and a rear section side thereof with a through hole 463 for the steel wire 430 to pass through and is arranged with a mid wall 464 so that a rear end of the tension spring 453 can be fixed thereto.

Now, the operation of the door opening apparatus of a washing machine according to the third embodiment of the present invention will be described.

As illustrated in FIG. 10, when the user steps on the tread 412 of the pedal 410, the pedal 410 starts to pivot around the hinge axis 411 to thereby raise the tripping pin 423.

Accordingly, the roller 422 is rotated clockwise about the hinge axis 421 so that the steel wire 430 is wound therearound.

At this time, the steel wire 430 serves to pull down a rear end of the rear door 402 connected to an upper end thereof.

Accordingly, a front side of the rear door 402 is lifted and, at the same time, a rear side of the front door 401 is raised as illustrated in FIG. 11.

The rear door 402 is simultaneously folded in parallel with the rear door 202 so that the opening of the top cover 10 is opened.

At this time, when the user releases the tread 230, the moving roller 452 is moved backward horizontally and simultaneously rotated by tensile force from the tension spring 453 as illustrated in FIG. 12, to thereby pull backward the steel wire 430 so that the roller 422 of the traction means 420 is rotated counterclockwise.

When the roller 422 is rotated counterclockwise, the tripping pin 423 disposed at one side thereof presses against a rear side of the pedal 410 to reinstate the pedal 410 horizontally.

Meanwhile, as illustrated in FIG. 12, when the front door 401 is manually pulled forward by way of the handle 403 (see FIG. 9) formed on the door means 400 in order to close the opening at the top cover 10 after the laundry is inserted into or taken out of the spin-dry tub 60 (see FIG. 1), the front door 401 and the rear door 402 are unfolded and are placed over the opening of the top cover 10 to thereby close the opening.

At this time, when the rear end of the rear door 402 is pulled upward, the steel wire moves the moving roller 452 forwardly against the tension spring 453 of the tension means 450 to a position where both ends of the moving axle 452 contact a front end of the oval hole 462 so that the steel wire 430 can be pulled upward by as much as the distance between the moving roller 452 and the fixed roller 451 at an initial stage, to thereby close the door means 400 completely as illustrated in FIG. 10.

As seen from the foregoing, there is an advantage in the door opening apparatus according to the third embodiment of the present invention in that, the steel wire is pulled when the pedal is stepped on, to lift the door means and to thereby open the opening of the top cover, so that the laundry can be easily inserted into or taken out of the spin-dry tub although the hands of the user are fully tied up with the washing clothes or detergents.

Next, a door opening apparatus of a washing machine according to a fourth embodiment of the present invention will be described with reference to FIGS. 13–16.

FIG. 13 is a schematic diagram for illustrating a door opening apparatus of a washing machine according to the fourth embodiment of the present invention.

As illustrated in FIG. 13, a top cover 505 is provided at one lower side thereof with a motor 522 as a driving source for opening door means 500, and the motor 522 is connected to a crank member 524 through the medium of a bolt 534 so as to be integrally rotated according to rotation of the motor 522.

Furthermore, a steel wire is fixed to the crank member 524, and to a fixed member 528 of the door means 500 while passing around a roller 530.

In other words, the steel wire 526 is fixed to a rear end of the door means 500 by way of a fixing member 528 so as to transfer a rotary torque applied to the steel wire 526 to a rear end of the door means 500.

The door means 500 is provided at one side of the rear end thereof with a hinge pin 560 so that the door means 500 can rotate around the hinge pin 560.

As illustrated in FIG. 14, the crank member 524 is assembled to the rotary axis 522*a* by the bolt 534 and washer 536 so as to be integrally rotated with the rotary axle 522*a* of the motor 522.

Furthermore, the top cover 505 is formed at a predetermined position thereof with a guide hole in order to guide movement of the steel wire 526.

FIG. 15 is a circuit diagram of a door opening apparatus of a washing machine according to the fourth embodiment of the present invention.

As seen in FIG. 15, control means 538 is a microcomputer for controlling the washing operation and door opening operation.

First of all, power supply mens 540 is connected to the control means 538 in order to supply direct current DC voltage to the control means 538 and a motor driving circuit (later described).

The power supply means 540 includes a transformer 552 for receiving an alternating current AC voltage of 220 V from an outside AC power source 550 to thereby transfer the same to an AC voltage of 12 V, a bridge diode 554 for receiving the AC voltage of 12 V from the transformer 552 to thereby transform the same to a DC voltage of 12 V, a capacitor C3 for stabilizing a waveform of the DC voltage of 12 V output from the bridge diode 554, and a voltage regulator 556 for receiving the DC voltage of 12 V from the bridge diode and the capacitor C3 to thereby output a DC voltage of 5 V.

Door detecting means 542 is connected to the control means 538 in order to detect an open state of the door means 500, so that a door open detecting signal can be output to the control means 538.

The door detecting means 542 includes a door switch SW1 for being activated when the door means 500 is opened and for being deactivated when the door means 500 is closed, and resistors R1 and R2 and a capacitor C1 for receiving a DC voltage of 5 V from power source means 540 when the door switch SW1 is deactivated to thereby output a voltage of high level to an input terminal I1 of the control means 538.

Pedal press detecting means 544 is connected to the control means 538 in order to detect a pressed state of the pedal (not shown) and to output a signal detected therefrom to the control means 538.

The pedal press detecting means 544 includes a pedal switch SW2 for being activated when the pedal is pressed and for being deactivated when the pedal is not pressed, and resistors R3 and R4 and a capacitor 2 for receiving a DC voltage of 5 V output from the power supply means 540 when the pedal switch SW2 is activated to thereafter output a voltage of high level to an input terminal 12 of the control means 538.

A motor driving circuit 548 is connected to the control means 538 in order to drive the motor 522 for opening the door means 500 by receiving a control signal from the control means 538 according to the detected signal output from the pedal press detecting means 544 and the door detecting means 542, where the motor driving circuit 548 includes transistor Q1 for receiving a control signal of high level from an output terminal (01) of the control means 522 to thereafter be activated, and a relay (RY1) for being operative so as to apply a DC voltage to the motor 522 when the transistor Q1 is activated.

Now, the operation of the door opening apparatus thus constructed according to the fourth embodiment of the present invention will be described.

FIG. 16 is a flow chart for schematic illustration of a door opening apparatus according to the fourth embodiment of the present invention.

First of all, reference symbol S in FIG. 16 represents a step.

In the description of the door opening apparatus of a washing machine according to the fourth embodiment of the present invention, it is presumed that the door means 500 has closed the washing tub 20 (refer to FIG. 1) as an initial condition for explaining the operation of door opening and closing methods.

At step S1, when the user applies an electric power source, an AC voltage of 220 V is supplied to the transformer 552 at the voltage supply means from an outside AC power source 550, and DC voltage of the 12 V is supplied to the bridge diode 554 from the transformer 552 of the voltage supply means 540. Then, the DC voltage of 12 V is output to the capacitor C3 from the bridge diode 554.

Successively, the voltage regulator 556 is supplied with DC voltage of 5 V from the capacitor C3, and an input terminal I3 of the control means 538 is supplied with the DC voltage of 5 V.

The control means 538 then starts the control operation.

At step S2, the control means 538 discriminates whether the pedal switch SW2 is activated.

As a result of the discrimination, if the pedal switch SW2 is activated (in case of yes) by the user's stepping on the pedal (by way of reference, although the pedal in the fourth embodiment is not described in its construction, the construction thereof is quite similar to those of the second and third embodiments), the control means 538 proceeds to step S3 to discriminate whether the door means 500 is opened.

At step S3, the control means 538 serves to discriminate whether the door means 500 is opened. As a result of the discrimination, if the door means 500 is not opened (in case of no) because a detecting signal of low level is input to the input terminal I2 of the control means 538 from the door detecting means 542, the control means 538 advances to step S4 to open the door means 500.

As step S4, a voltage of high level is applied to a base of the transistor Q1 for a predetermined open period in the control means 538 through the medium of resistors R4 and R5 of the motor driving circuit 548 from an output terminal of of the control means 538.

Then, the transistor Q1 is activated and a current flows in the relay RY1. A movable contact RY1*a* of the relay RY1 is then connected to a fixed contact RY1*b* of the relay RY1.

Voltage is applied to the motor 522 from the bridge diode 554 and the capacitor C3 of the power supply means 540, and the motor 522 is rotated counterclockwise in FIG. 13.

The crank member 524 is moved counterclockwise to reach a position shown in alternate long and two short dashes line.

The wire 526 is pulled to a direction of the alternate long and short two dashes line in FIG. 2 according to the rotation of the rotary member 524.

When the wire 526 is drawn, the door means 500 is pulled downward. The door means 500 is rotated at a rear portion thereof clockwise around the hinge pin 560 to thereafter reach a position illustrated in the alternate long and short two dashes line in FIG. 13. At this time, the door means 500 is folded to an open state.

Meanwhile, at step S2, if it is discriminated that the pedal switch SW2 is not activated (in case of no), the present status is being maintained because there is no input of an open command of the door means 500 from the user.

At step S3, if it is discriminated that the door means 500 is opened (in case of yes), the present status is being maintained because there is no need to re-open the door means 500. The door means 500 has been already opened.

When the user wants to close the door means 500, he or she can pull the handle of the door means forwardly (not shown in this embodiment but in the same construction as described in the second and third embodiment) to thereby unfold and close the door means 500.

Meanwhile, when the user wants to open the door means 500 manually without using the pedal (not shown), he or she can pull the handle of the door means 500 upward and at the same time, push the same backward, to fold and open the door means 500.

As seen from the foregoing, there is an advantage in the door opening apparatus of a washing machine according to fourth embodiment of the present invention in that the user can open the door means by way of a step-on on a pedal formed at a lower side of a body of the washing machine, allowing easy and convenient use of the washing machine.

The foregoing description of the preferred embodiments has been presented for the purpose of illustration and description. It is not intended to limit the scope of this invention. Many modifications and variations are possible in light of the above teaching. It should be noted that the present invention can be applied to all kinds of the apparatus within the scope of the above presentation.

What is claimed is:

1. A clothes washing machine comprising:

a housing including a top cover having an opening;

a wash tub disposed within the housing;

a spin basket rotatably mounted within the wash tub for rotation about a vertical axis for receiving clothes inserted through the opening;

an agitator mounted in the spin basket and rotatable about a vertical axis for agitating clothes therein;

a door assembly mounted to the top cover for closing the opening and including first and second pivotally interconnected doors for being folded together about a horizontal axis to define an open position, and unfolded to define a closed position, the first door having a first end pivoted to the top cover and a second end, the second door having a first end pivoted to the second end of the first door and a second end, a lever extending downwardly from the second end of the second door and carrying a roller for rolling upon the top cover, the roller constituting a weight supporter for supporting weight of the door when the door assembly moves between the open and closed positions;

at least one pulley mounted on the housing adjacent the second end of the second door for rotation about a horizontal axis;

a reversible motor mounted to an underside of the top cover;

a bobbin structure connected to the motor for rotation thereby;

a pair of first and second wires each having a first end connected to the lever, the first wire extending around the at least one pulley, each of the first and second wires including a second end wound around respective portions of the bobbin structure whereby the first wire pulls the door assembly closed when the motor is actuated in a first rotary direction and the second wire pulls the door assembly open when the motor is actuated in a second rotary direction opposite to the first rotary direction.

2. The clothes washing machine according to claim 1 wherein the at least one pulley comprises a pair of vertically spaced pulleys, the first wire extending around both of the pulleys.

* * * * *